United States Patent [19]

Baur et al.

[11] 4,385,792

[45] May 31, 1983

[54] PROTECTIVE COVER FOR ELECTRICAL CONNECTOR RECEPTACLE OPEN END, PROVIDING RFI/EMI SHIELDING

[75] Inventors: Robert Baur, Los Angeles; Ralph T. Iversen, Granada Hills, both of Calif.

[73] Assignee: Automation Industries, Inc., Greenwich, Conn.

[21] Appl. No.: 165,722

[22] Filed: Jul. 3, 1980

[51] Int. Cl.[3] ..... H01R 13/44

[52] U.S. Cl. ..... 339/36

[58] Field of Search ..... 339/36–38

[56] References Cited

U.S. PATENT DOCUMENTS

| | | | |
|---|---|---|---|
| 3,176,257 | 3/1965 | Introvigne | 339/36 |
| 3,182,280 | 5/1965 | Daut et al. | 339/38 |
| 3,327,279 | 6/1967 | Lombard | 339/36 |

FOREIGN PATENT DOCUMENTS

| | | | |
|---|---|---|---|
| 246955 | 8/1962 | Australia | 339/36 |
| 2840696 | 3/1980 | Fed. Rep. of Germany | 339/37 |

*Primary Examiner*—Joseph H. McGlynn

*Attorney, Agent, or Firm*—Francis N. Carten

[57] ABSTRACT

The invention is directed to a protective cover for the open face of the receptacle section of a multi contact electrical connector when the receptacle section and the plug section are not mated. The protective cover comprises a barrel and a cover plate closing one end of the barrel. Inside the barrel there is positioned a spring means so located that a disc placed over the spring means can be controllably moved longitudinally in said barrel to contact the end of said receptacle open face. At the outer end of said barrel are indexing means for polarized alignment with indexing means on said receptacle and locking means, for locked retainment of said cover to said receptacle socket.

10 Claims, 19 Drawing Figures

PROTECTIVE COVER FOR ELECTRICAL CONNECTOR RECEPTACLE OPEN END, PROVIDING RFI/EMI SHIELDING

BACKGROUND OF THE INVENTION

1. Field of the Invention

This invention relates to multicontact electrical connectors. Particularly the invention relates to a protective cover for the receptacle open end of such a connector. Especially, the invention relates to such covers that provide RFI/EMI shielding.

2. Description of the Prior Art

In the case of aircraft wing installations electrical connectors present a special problem when only the receptacle section is present, that is, when the plug section is not needed for a particular flight. The open socket end of the receptacle permits air flow buffeting of the contacts, and, especially harmful, exposes the internal aircraft circuitry, connected to the receptacle, to RFI/EMI effects coming in through the open end of the contacts; also it permits entry of rain, dust, or simple humidity into the open end of the receptacle.

In most instances, a protective cover is required for the receptacle open end when the receptacle and plug sections are not mated. Depending on the degree of protection required these covers vary from simple polyethylene covers to metal covers of increasing complexity, covers which have multifingered conductive spring bands for RFI/EMI shielding; O-rings or other types of gaskets for moisture proofing; threads or other forms of attachment and retainment. Increasingly severe specifications have forced more and more complexity onto these covers. These more complex covers are not only heavy, because they are made of metal, but also they are expensive.

OBJECTS

At the present time the most sophisticated covers for the receptacle open end are required to meet most of, and desirably all of, the following:

1. The buffeting and stresses when used on fighter aircraft.
2. The cover must provide an aerodynamic profile, especially when used on fighter aircraft wings.
3. The cover must shield against entry or exiting of RFI/EMI.
4. The cover must seal against entry of moisture, both liquid (rain) and humidity.
5. The cover must withstand the ravages of five hundred (500) hours continuous exposure to salt spray in a defined test procedure.
6. The cover must attach to and be retained with (locked to) the unmated open socket end of the receptacle, which recpetacle is mounted in a cavity on the underneath side of the wing.
7. The cover must be light in weight.
8. The cover should be cost effective (inexpensive even though having large benefits).

It is evident that several of the above requirements apply to other situations, such as, ships and boats; motor vehicles; railway vehicles; exteriors of buildings in adverse environments, dessert and the seashore.

Each of the above requirements forms an object of the instant invention. Desirably more than one object is attained by a particular embodiment of the instant invention. Preferably all of the above requirements are met by one or more embodiments of the instant invention. Other requirements, not listed, can be met by one or other embodiment of the invention.

SUMMARY OF THE INVENTION

This invention is directed to a protective cover for the open end of the receptacle section of a multicontact cylindrical electrical connector, when said receptacle is not mated with the plug section of said connector. Said cover comprises: a barrel having indexing means at the open end thereof for unique alignment with a receptacle open end, having means for retainment of said barrel at said open end; and a plate means for closing the other end of said barrel. Desirably there are included means for locking the cover and the receptacle together. Preferably, the barrel is made up of at least two wall portions, one of which includes said indexing means and there is included a member for controlling the longitudinal travel of a disc positioned inside said barrel. The cover includes an elastomer member positioned on the exterior of said barrel for sealing contact with said receptacle open end. Desirably said elastomer member is made from silicone rubber; preferably said member is fluorosilicone rubber for aircraft usage of said cover. Preferably the retainments include spring means for applying pressure to the receptacle open end to maintain said retainment and also to lock said cover to said receptacle open end. Preferably said spring means acts on a longitudinally movable disc which contacts the open end of said receptacle and said barrel includes means for controlling the length of travel of said disc. Preferably the spring means includes a plurality of conical coil compression springs. When present, the disc assists in the locking of said barrel to said receptacle open end. A plate means for closing the other end of said barrel, may include an exterior handle. The plate means may be a unitary construction with the barrel or a portion of the barrel.

Preferably the cover body (barrel plus plate) is made of non-conductive, rigid plastic, such as, glass fiber filled nylon 6/6. Preferably the disc is made of metal, such as, nickel plated phosphor bronze, to provide RFI/EMI shielding.

In a preferred embodiment, the indexing means are keyways affording unique alignment with keys located on said receptacle end and means operative with said keys for retainment of, and for locking, said barrel to said receptacle open end.

DESCRIPTION OF A PREFERRED EMBODIMENT

Figure 1:
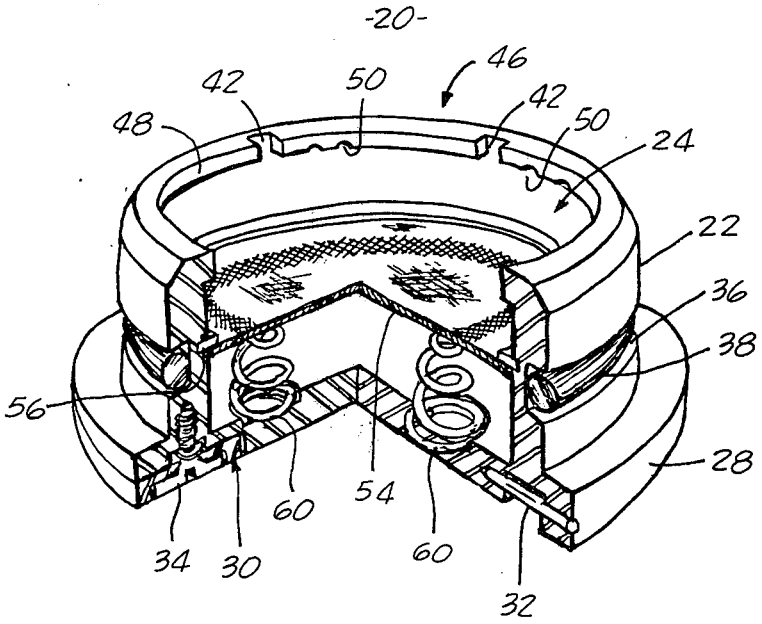
FIG. 1 is a schematic view in partial cross section of one embodiment of the cover of the invention.

In the figures, FIG. 1 is a schematic isometric, with a partial cross section, of one embodiment of this invention. Cover 20 comprises a unitary barrel 22 having an open end 24. A plate means 28 closes the other end of barrel 22. Plate 28 includes a handle 30, here a foldable handle in a cavity to retain a plane surface, with hinge pin 32 and a captive screw 34 for locking the handle 30 in the cavity. as will be more particularly described, the handle is used to place the cover 20 on the receptacle and remove it therefrom. The exterior of barrel 22 has an annular recess 36 for maintaining in place sealing O-ring 38.

The embodiment of FIG. 1 has a unitary barrel 22 and plate 28 constructed of molded hard, more or less rigid, plastic material. Such a unitary constructed is denoted a cover body. At the open end 24 of barrel 22, indexing means afford a unique alignment of the cover 20 with a particular receptacle open end which is to be covered by cover 20. FIG. 1 shows two of the three keyways 42 which, in cooperation with keys on the exterior of said receptacle open end perform the indexing (also known as polarization). Also at the open end 24, there are flange means 46 for retainment of barrel 22 at said receptacle open end, i.e., the cover 20, through the flange annular lip and detents 50, meshes with keys on the exterior of the receptacle end to lock together securely the cover and the receptacle.

In FIG. 1 a disc 54 has a controlled longitudinal travel inside barrel 22. Disc 54 is controlled in its travel by keeper ring 56 positioned in an annular cut, not numbered, in the barrel. When cover 20 is in place on said receptacle open end, disc 54 is held in tight contact with said receptacle open end by a plurality of conical coil compression springs 60 positioned underneath disc 54, and abutted in cavities in the inside surface of cover plate 28. The travel of disc 54, urged by spring means 60, is controlled to apply pressure to said receptacle open end, to maintain retainment of said cover on said receptacle and to lock said cover to said open receptacle open.

The barrel 22 is preferably made of non-conductive (insulator) more or less rigid plastic material. A preferred material is glass fiber filled nylon 6/6. The seal gasket 38, herein an O-ring, is desirably made of an elastomer, such as, silicone rubber; especially fluorosilicone rubber. Disc 54 may be non-conductive material when RFI/EMI shielding is not essential. For RFI/EMI shielding, disc 54 is made of conductive material; preferably nickel plated phosphor bronze with a gold flash finish.

Figure 2:
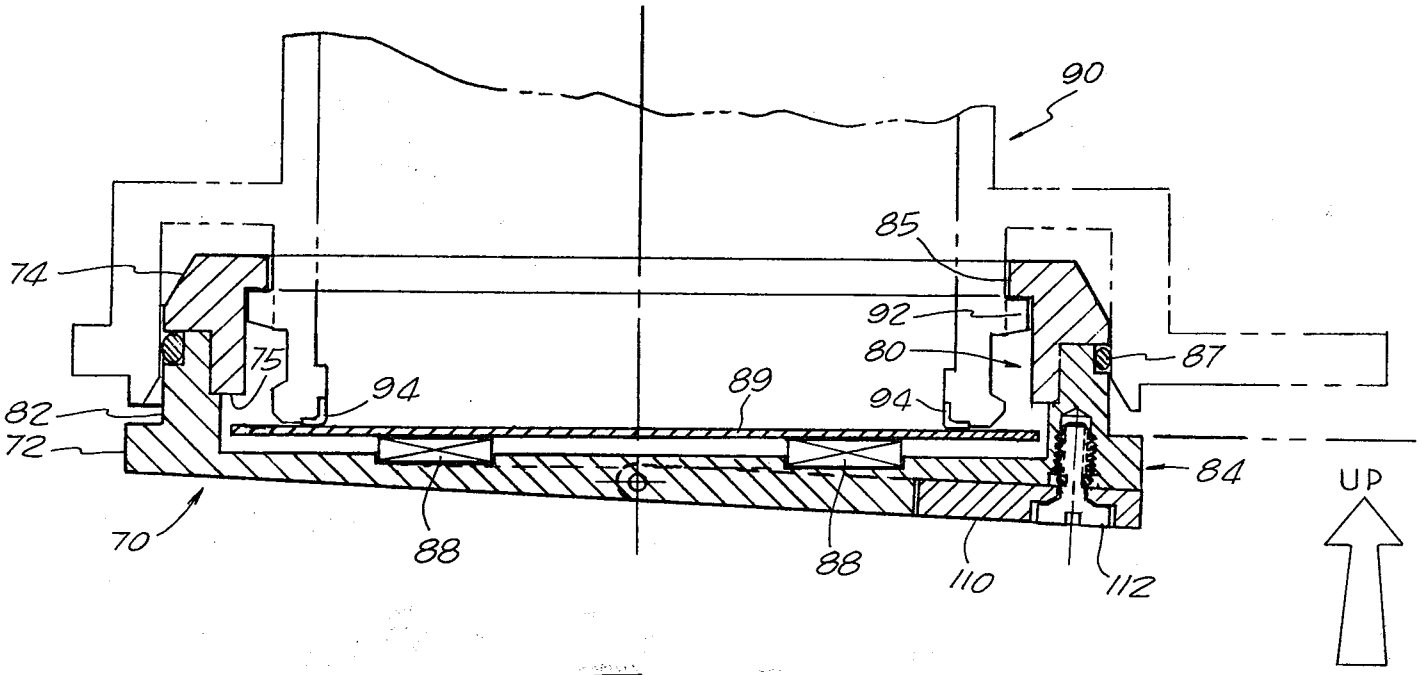
FIG. 2 is a side elevational, sectional view of a cover of the invention attached to the open end of a receptacle section, shown in phantom lines.

FIG. 2 shows an alternate embodiment of the cover of this invention. Here it is seen that the body 70 is made up of two separate pieces: the body cover top 72 (includes the plate) and body cover bottom 74 (includes indexing means). It is also seen that the barrel 80, which comprises body bottom 74 and wall extension 82 of body 72 is fashioned to have plate 84 slope at the aerodynamic profile of the underneath side of the aircraft wing to which receptacle 90 is attached, i.e., the profile (contour) of the wing matches the profile of the cover plate.

The receptacle for present purposes includes an open-ended tubular member having a set of peripheral keys whereby when properly polarized, the receptacle may be received within the described protective cover and on rotation is releasably locked therein.

Here lip 85 rides against the lower end of keys 92 to retain the cover on the receptacle. Spring means 88 force disc 89 into intimate contact with receptacle open end 94 not only resulting in good electrical contact with the metal disc, but also locking the cover and receptacle together (capture and maintain the receptacle key in the barrel detent). The intimate contact of disc 89 with the entire front face of the end of the receptacle opening in effect encloses all the electrical elements, such as, the receptacle contacts, which are susceptible to RFI/EMI, in a metal shield, thereby negating the need for a metal cover housing and fingered bands as used in other protective covers.

O-ring 87, located in annular recess 86, seals the cover and receptacle from penetration by either liquid water or atmospheric humidity.

Figures 3, 3A, 3B, 3C, 3D, 3E:
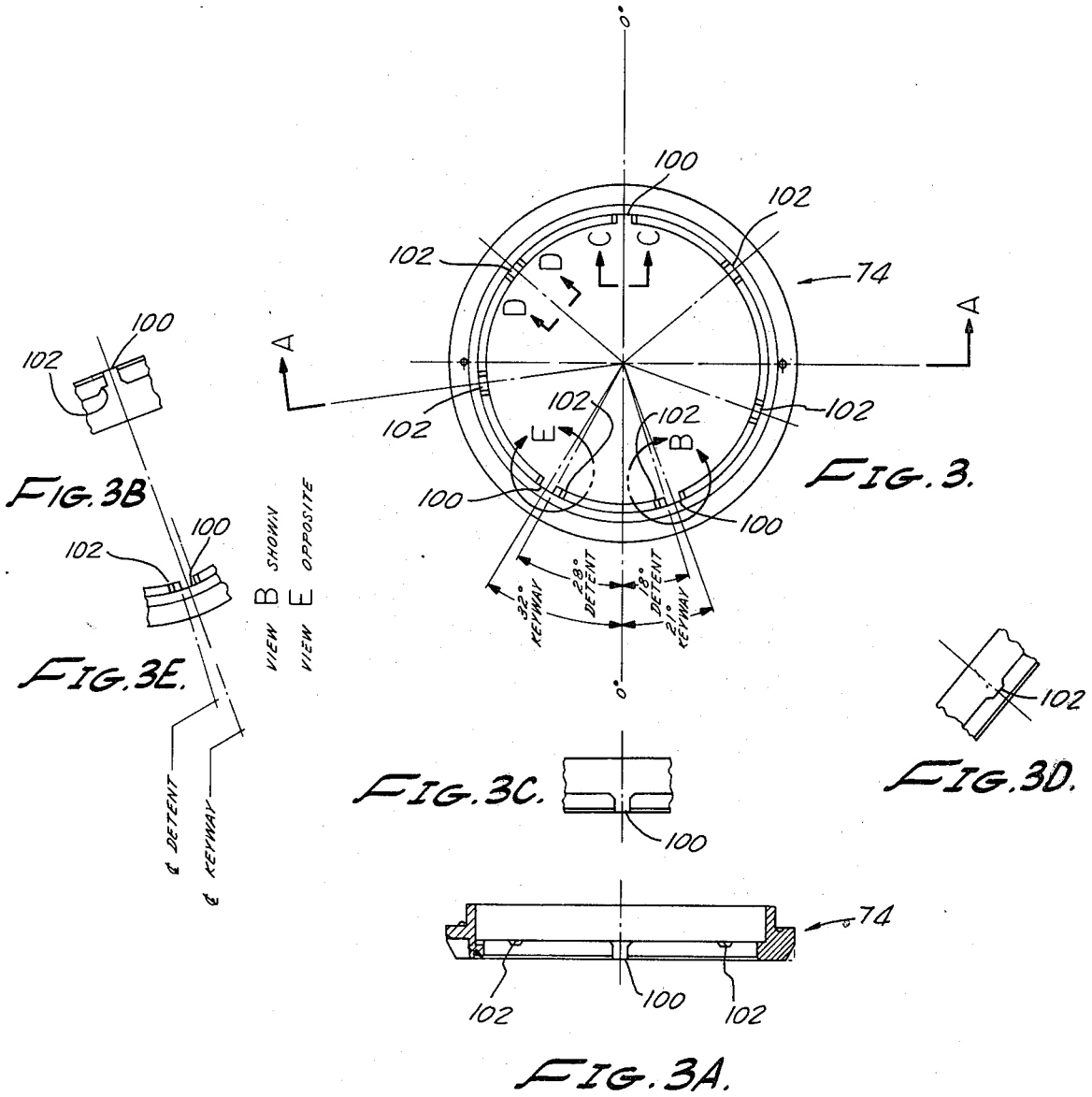
FIG. 3 is a bottom plan view looking up into the interior of the open end of the cover barrel.
FIG. 3A is a sectional view taken along A—A of FIG. 3, showing detents and a keyway.
FIGS. 3B–E are partial views of FIG. 3 at the designated locations of detent or keyway.

FIGS. 3–3E are directed to the body bottom 74 (barrel portion which includes the indexing means). FIG. 3 shows 3 keyways 100 and the angular spacing for this embodiment of the keyway. Also there are shown 4 detents (anti-rotation notches) 102 and their angular spacing. FIGS. 3B and 3E show different views of a keyway at "B" on FIG. 3. FIG. **3*d* is a view of a detent at D—D on FIG. 3. FIG. 3C shows a keyway at C—C on FIG. 3. FIG. 3A is a cross section of FIG. 3** at A—A showing a keyway and two detents.

Figure 4:
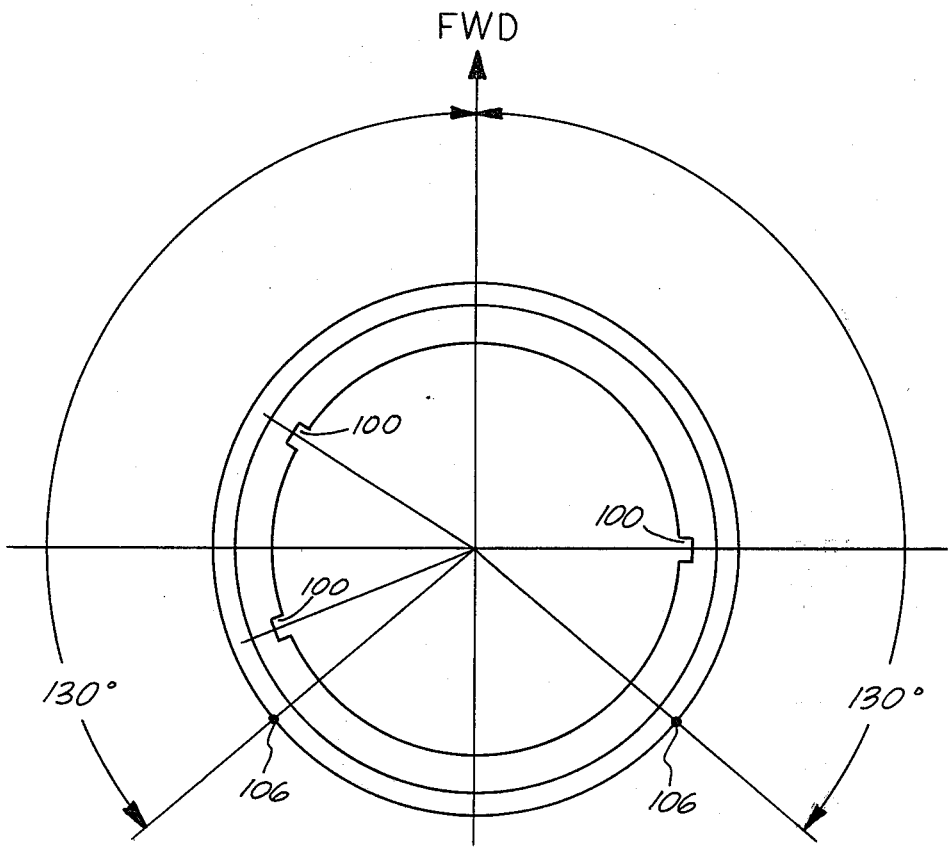
FIG. 4 shows one arrangement of three keyways to obtain a particular indexing with keys on the exterior of a particular receptacle socket opening, where FWD means forward.

FIG. 4 shows the three keyways 100 and two cover plate profile location positions 106 for this embodiment, at 130° from the FWD position. The cover plate profile location permits positioning with respect to the particular wing profile. Here the wing profiles vary from right wing to left wing by 100°. This position is maintained until manually removed by the handle 110 (identical to handle 30), which handle stows flush during flight (FIG. 5).

Figure 5:
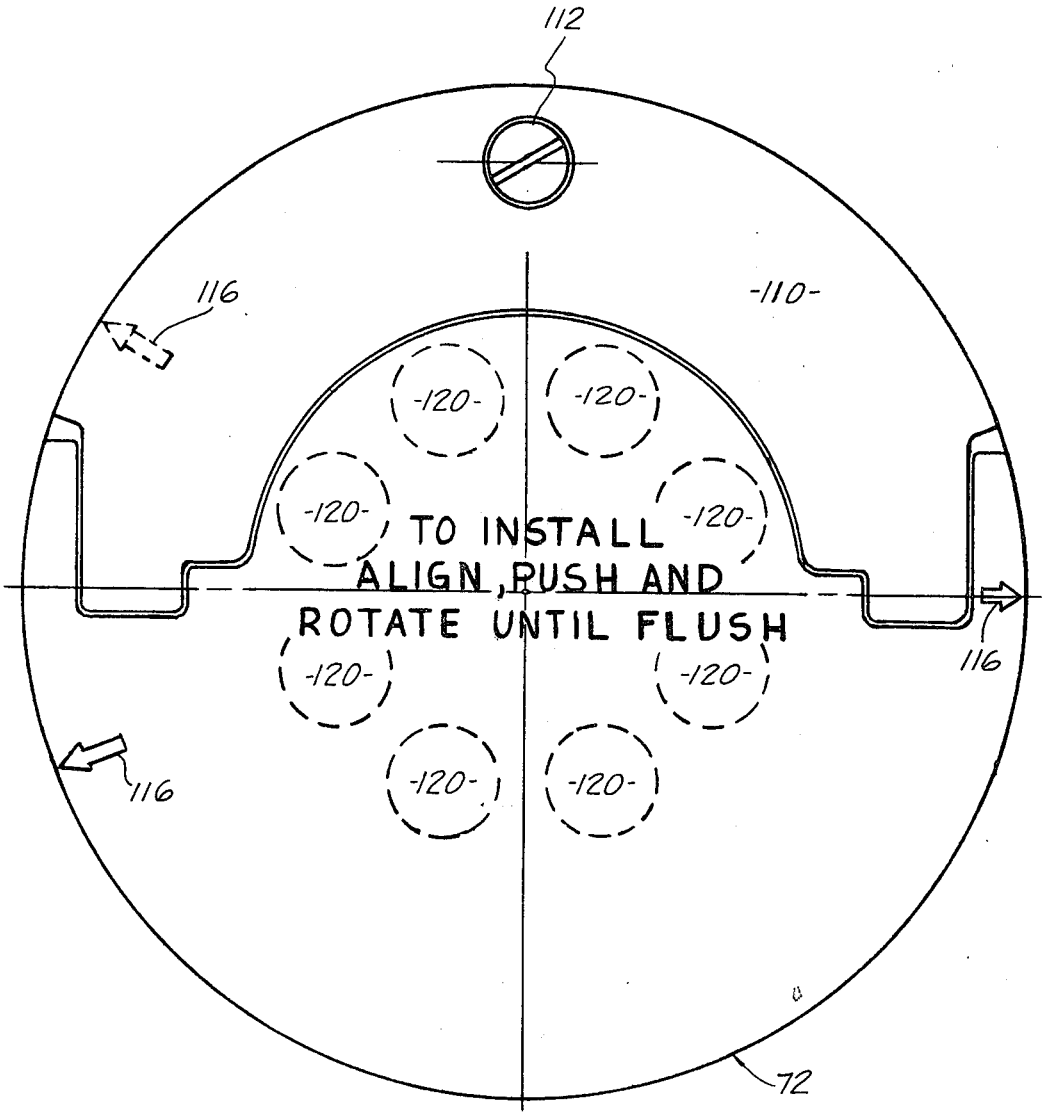
FIG. 5 is a view of the cover plate showing the fold down handle, indicators for three keyways, and dotted cavities for eight conical coil compression springs.

FIG. 5 shows a plan view of body cover top 72, handle 110, and captive screw 112 with arrows 116 for locating the keyways 100 in barrel portion 74. Spring retention cavities 120 on the inside of plate 72 are shown in dashed lines.

Figure 6:
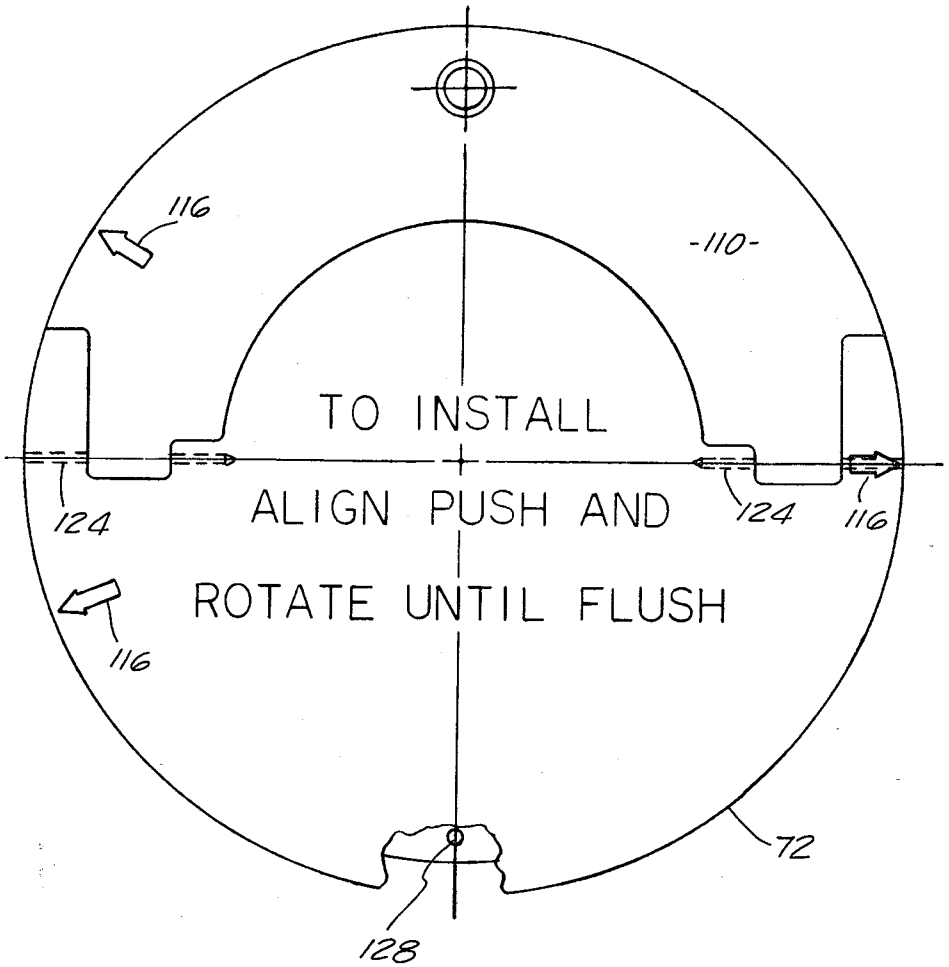
FIG. 6 is another view of the cover plate showing hinge pins for the handle.

FIG. 6 is another view of plate 72 showing hinge pins 124 for handle 110, desirably made of stainless steel. Indexing buttons 128 are spaced 180° apart. During the bonding of the cover, buttons 128 register the top half of the body to the bottom half thereof.

Figure 7:
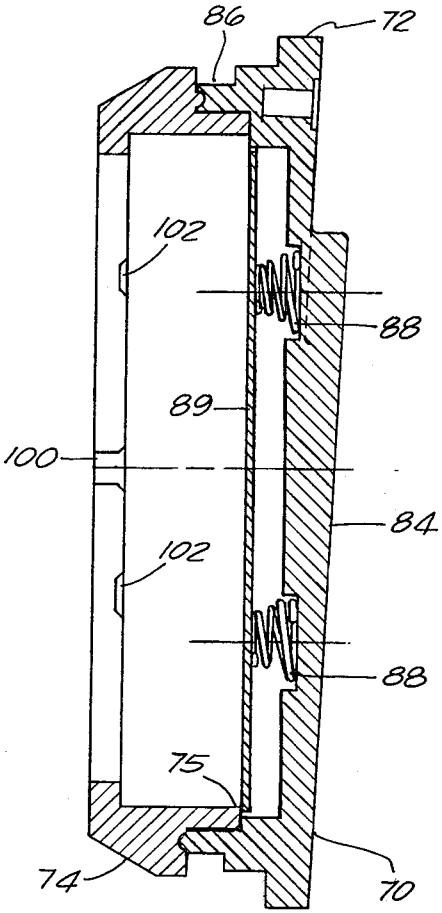
FIG. 7 is a cross section of the cover showing the springs and disc.

FIG. 7 has somewhat more detail than FIG. 2. FIG. 7 shows body 70, omitting the handle 110, formed of two pieces: the body cover top 72 and body cover bottom 74. Plate 84 is more clearly evident as having an aerodynamic profile matching the wing profile. Spring means 88 force disc 89 upward with a restraint shoulder 75 formed by body cover bottom 74. Annular recess 86 admits O-ring 87 (FIG. 2). Various spring means can be used to maintain pressure on the disc. Because of their ability to compress into a thin flat dimension upwardly, the conical coil depression springs are preferred. It is intended that all those springs which perform like the conical coil compression spring are included in the use of that name, for example, the single and double volute springs.

Figure 8:
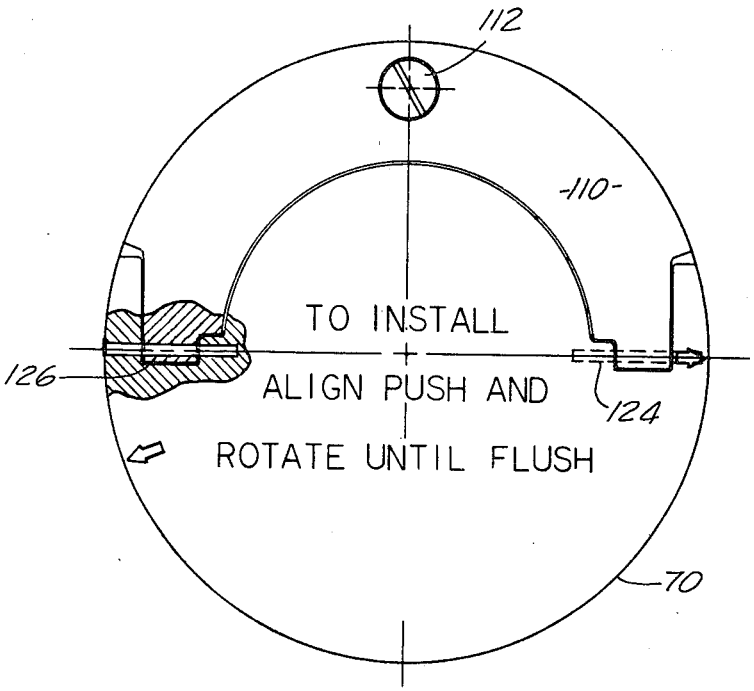
FIG. 8 is another view of the coverplate showing a detail of one handle hinge.
Figure 9:
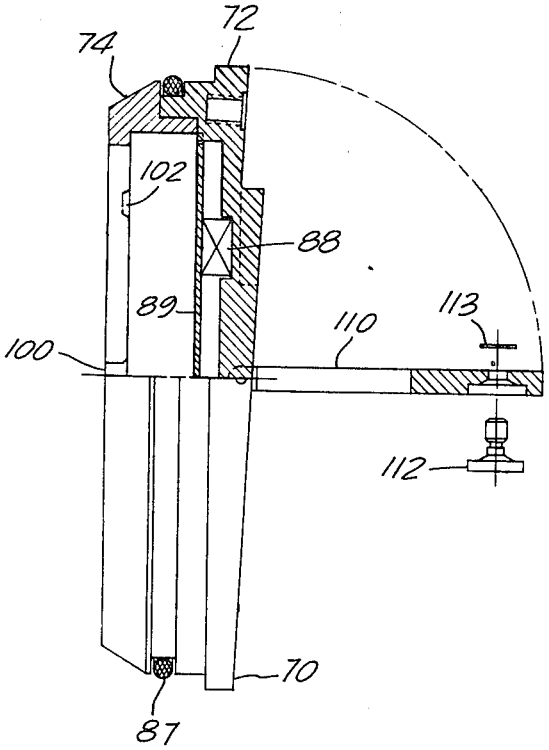
FIG. 9 shows a side view, in partial cross section with handle extended and one-type of retaining screw.

FIG. 8 is another view of the plate 70 showing handle 110, hinge pins 124, and hinge 126. FIG. 9 shows more detail of cover 70 showing O-ring 87 in place. Handle 110 is in the extended position with captive screw 112 removed from the handle and retaining ring 113 on the side of handle 110.

Figure 10:
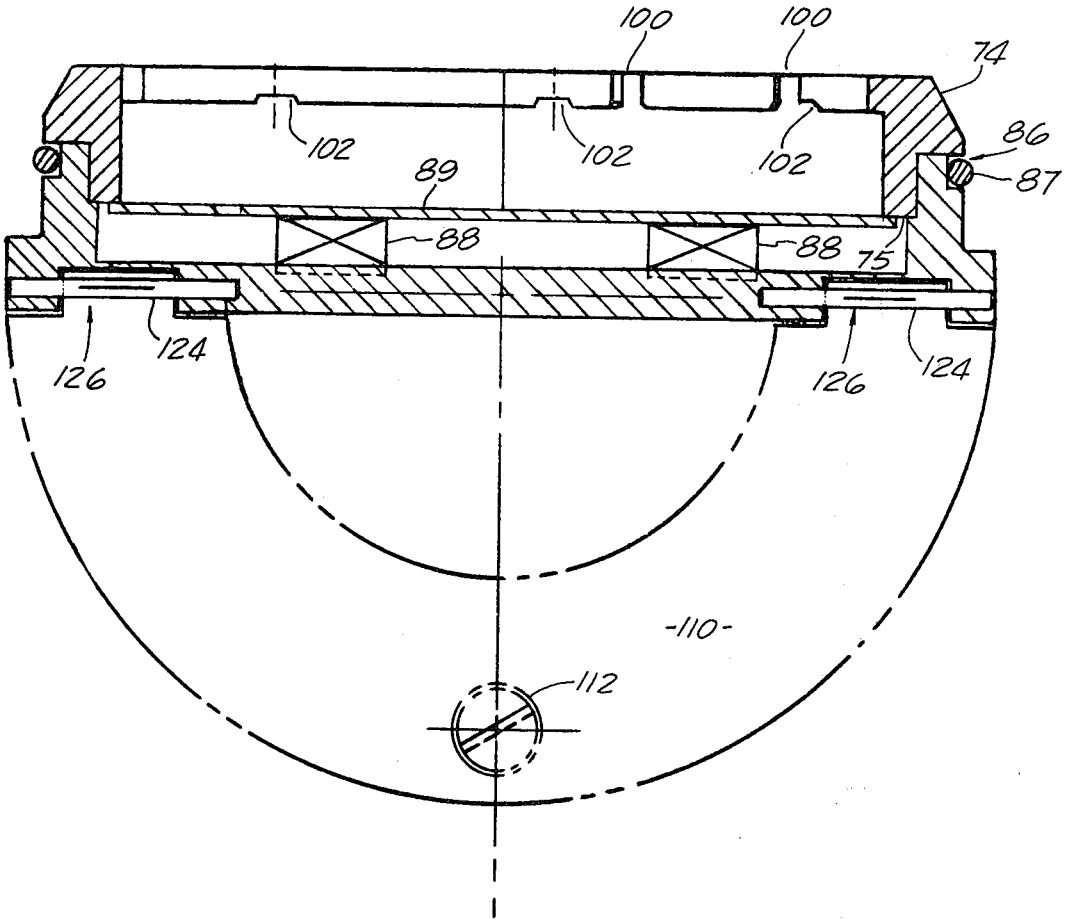
FIG. 10 is another partial cross sectional side view of the cover with extended handle.

FIG. 10 is another view of cover 70 with handle 110 extended, showing hinge pin 124 and hinge 126. Also spring means 88 urge disc 89 against shoulder 75. And O-ring 87 in annular recess 86. Three detents 102 and 2 keyways 100 are shown.

Figure 11:
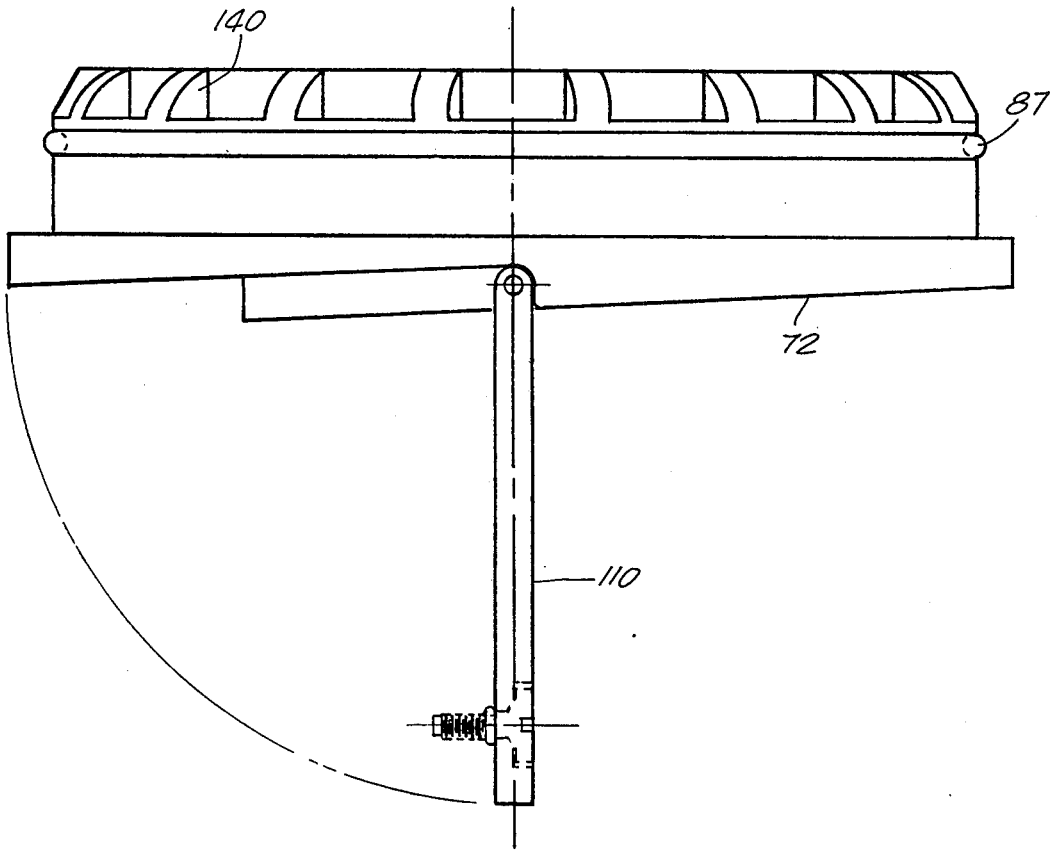
FIG. 11 is a side view of the cover with extended handle.
Figure 12:
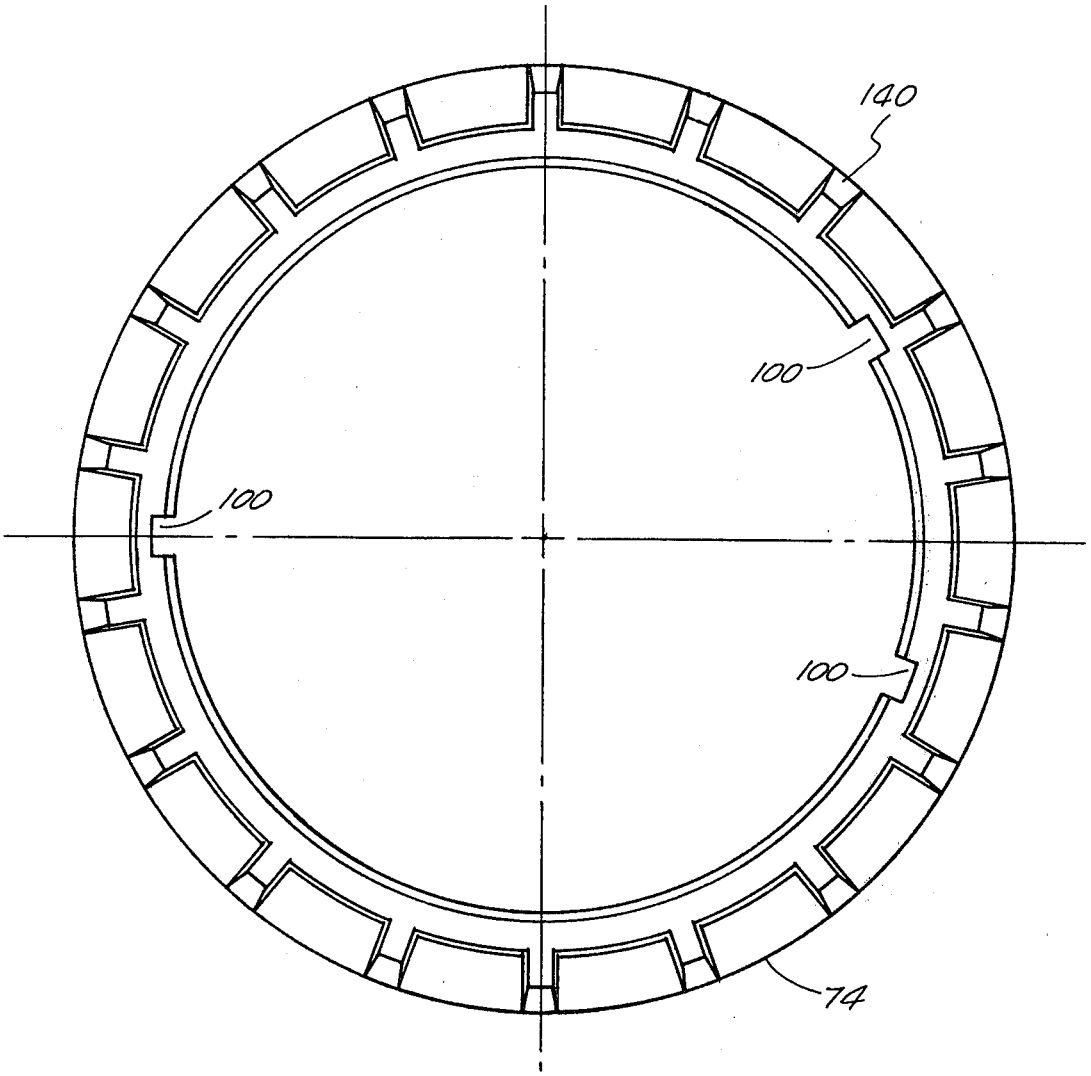
FIG. 12 is a bottom view of the barrel.
Figure 13:
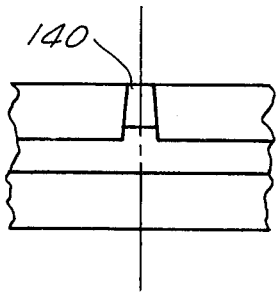
FIG. 13 is a detail of FIG. 12 in a side view.

FIG. 11 is a side view of the cover with handle extended. Body cover bottom 74 is reinforced on the exterior by a plurality of ribs 140. FIGS. 12–13 are a top view and side view, respectively, of two ribs 140 of bottom 74 showing detail of ribs 140 and keyway 100. The purpose of ribs 140 is to reduce heavy cross sectional molded area to achieve a more uniform wall section and to prevent distortion of the molded part.

Figure 14:
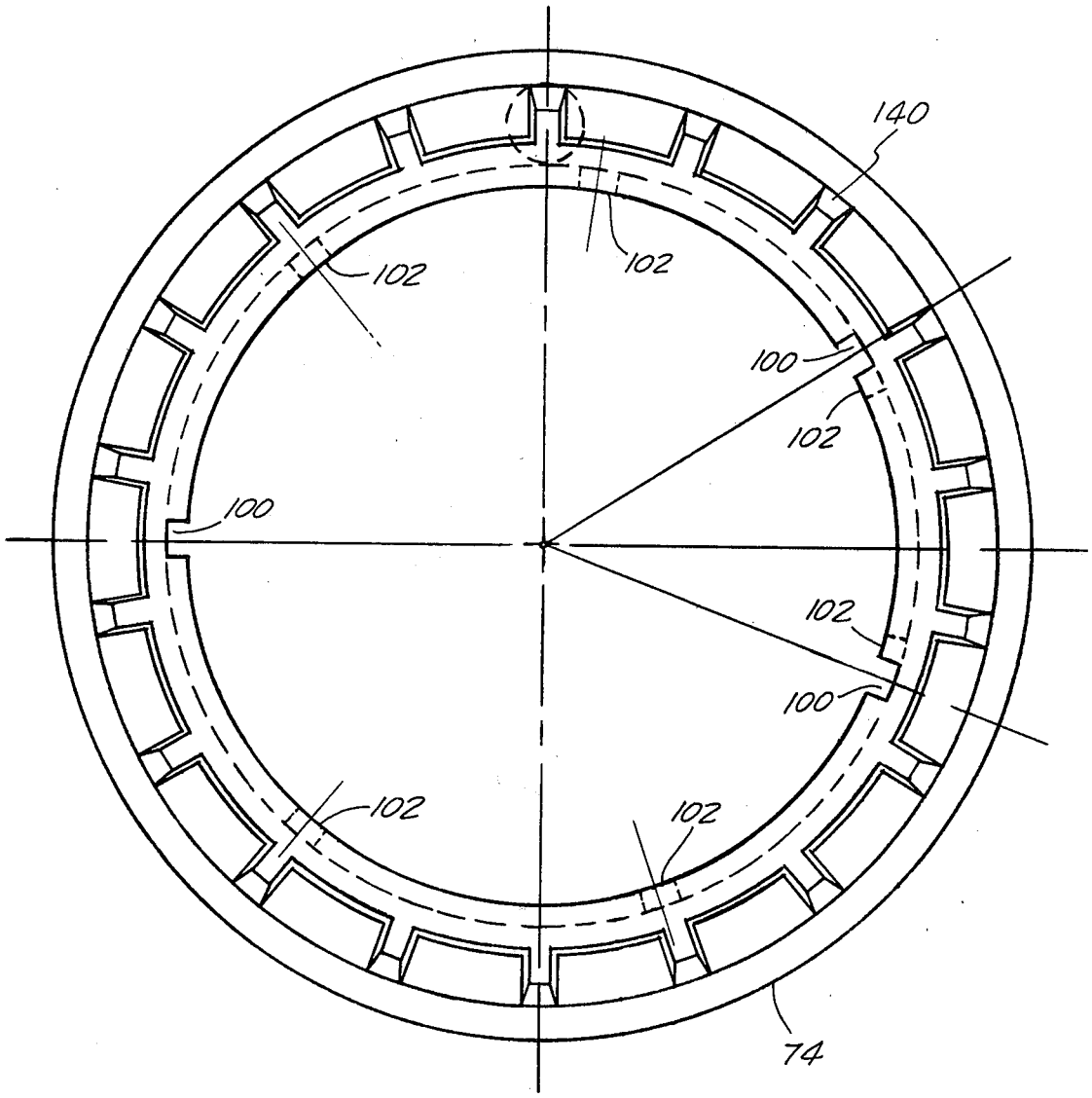
FIG. 14 is another bottom view of the barrel emphasizing the three keyways and dotted lines showing the location of the six detents in this embodiment.

FIG. 14 is another top view of bottom 74 showing ribs 140, keyways 100, and detents 102, in dashed lines.

Desirably the disc is forced to turn with the rotation of barrel as the cover is brought into indexed relation with receptacle open end, and rotated to the detents controlling the particular wing profile. This movement with the barrel aids in forcing intimate electrical contact of the disc and receptacle open end. Preferably, the inside of the barrel is provided with a longitudinal arcuate protrusion and the disc is notched to accept the barrel protrusion.

In use, the cover is oriented by aligning the keyways with the keys on the exterior wall of the receptacle open end. The nonconductive, rigid cover, overcoming the spring resistance, is forced upward (big arrow in FIG. 2) until the barrel lip extends beyond the top of the keys and the metal disc is in contact with end 94 of the receptacle. Then handle 110 is rotated in the direction required to have the plate profile match the wing profile, forcing the spring loaded disc into intimate contact with receptacle end 94, which permits retainment of cover and receptacle. Then the cover and receptacle are are locked together by further rotation which meshes the keys into detents 102. O-ring 87 seals against the receptacle cavity and precludes entrance of moisture. Handle 110 is returned to its cavity and is captivated by screw 112.

It is to be understood that other embodiments may be developed by ordinary skill in the light of this description. These other embodiment are intended to be a part of this invention.

Thus having described the invention, what is claimed is:

1. A cover for a cylindrical electrical connector receptacle open end, comprising:

a barrel having indexing means at an open end thereof for unique alignment with the receptacle open end;

means for retainment of said barrel at said receptacle open end including spring means for applying pressure to said receptacle open end to maintain retainment and to lock the cover to the receptacle open end;

a disc movably located within the barrel and contacting said spring means which resiliently urges said disc against the receptacle open end;

means carried by said barrel for controlling the travel of said disc; and plate means for closing the other end of said barrel.

2. The cover of claim 1 including an elastomer member positioned on the exterior of said barrel for sealing contact with said receptacle open socket end.

3. The cover of claim 1 where said elastomer member is a silicone rubber O-ring.

4. The cover of claim 1 wherein said spring means includes a plurality of conical coil compression springs.

5. The cover of claim 1 wherein said disc is made of material providing RFI/EMI shielding.

6. A protective cover for a cylindrical electrical connector receptacle open end, which cover comprises:

a barrel having wall portions enclosing a cavity, which wall portions include at an open end of said barrel cavity keyway indexing means for unique alignment on a receptacle open end with keys located thereon, and means operative with said keys for retainment of, and for locking, said barrel to said receptacle socket;

spring means positioned in said barrel cavity comprising a plurality of conical coil compression springs operating on a longitudinally movable disc, which disc contacts said receptacle open end and assists the locking of said barrel, said barrel including a member for controlling travel of said disc;

an elastomer member positioned on the exterior of said barrel for sealing contact with said receptacle open end; and a plate means provided with an exterior handle for closing the other end of said barrel.

7. The cover of claim 6 where said elastomer member is a silicone rubber O-ring.

8. The cover of claim 6 wherein said plate means is contoured to match a lower wing profile of an aircraft containing said receptacle.

9. The cover of claim 6 wherein said disc is made of material providing RFI/EMI shielding.

10. The cover of claim 9 wherein said disc is made of phosphor bronze.

* * * * *